US005348281A

United States Patent [19]

Yamada et al.

[11] Patent Number: 5,348,281

[45] Date of Patent: Sep. 20, 1994

[54] SHEET REFEEDING DEVICE FOR USE IN PRINTING APPARATUS HAVING A TIMED PRESSING MEMBER

[75] Inventors: Yasushi Yamada; Tsuyoshi Mizubata; Masaru Ushio, all of Hachioji, Japan

[73] Assignee: Konica Corporation, Tokyo, Japan

[21] Appl. No.: 73,963

[22] Filed: Jun. 7, 1993

Related U.S. Application Data

[63] Continuation of Ser. No. 885,317, May 18, 1992, abandoned.

[30] Foreign Application Priority Data

| | | | |
|---|---|---|---|
| May 22, 1991 | [JP] | Japan | 3-146764 |
| May 22, 1991 | [JP] | Japan | 3-146765 |
| May 22, 1991 | [JP] | Japan | 3-146766 |
| Jun. 20, 1991 | [JP] | Japan | 3-176233 |
| Jun. 20, 1991 | [JP] | Japan | 3-176234 |

[51] Int. Cl.[5] ..... B65H 5/22

[52] U.S. Cl. ..... 271/3.1; 271/110; 271/160

[58] Field of Search ..... 271/3.1, 114, 126, 147, 271/160, 165, 166, 110

[56] References Cited

U.S. PATENT DOCUMENTS

| | | | |
|---|---|---|---|
| 5,020,788 | 6/1991 | Hatano et al. | 271/126 |
| 5,165,677 | 11/1992 | Shinada | 271/3.1 |
| 5,169,135 | 12/1992 | Hamanaka et al. | 271/3.1 |
| 5,186,446 | 2/1993 | Saeki et al. | 271/3.1 |
| 5,219,156 | 6/1993 | Mori | 271/160 X |

FOREIGN PATENT DOCUMENTS

| | | | |
|---|---|---|---|
| 78017 | 5/1984 | Japan | 271/3.1 |
| 59-82247 | 5/1984 | Japan . | |
| 59-114227 | 7/1984 | Japan . | |
| 60-2241 | 1/1985 | Japan . | |
| 62-161641 | 7/1987 | Japan . | |
| 255325 | 11/1987 | Japan | 271/3.1 |

*Primary Examiner*—Robert P. Olszewski
*Assistant Examiner*—Boris Milef
*Attorney, Agent, or Firm*—Frishauf, Holtz, Goodman & Woodward

[57] ABSTRACT

A recording sheet feeding device for use in an image forming machine, in which a plurality of sheets on which a first image has been recorded are successively fed from a sheet stacker for a second image to be formed, provided with a sheet pressing mechanism above the stacker which takes a pressing or a non-pressing position with respect to sheets on the stacker. While sheets are being conveyed to the stacker, a pressing operation on the sheets is conducted by driving the mechanism at least twice. Sheet feeding from the stacker is started after the first pressing operation of the mechanism. A feeding timing of the first sheet to be fed after a second pressing operation is delayed compared with a feeding timing of other sheets. In another structure, a periodical pressing operation is conducted each time a predetermined number of sheets are conveyed into the stacker and feeding is started when a sheet preceding by a fixed number from the last sheet in a set number of sheets in the first image forming operation is conveyed into the stacker.

11 Claims, 12 Drawing Sheets

SHEET REFEEDING DEVICE FOR USE IN PRINTING APPARATUS HAVING A TIMED PRESSING MEMBER

This application is a continuation, of application Ser. No. 07/885,317 filed May 18, 1992, now abandoned.

BACKGROUND OF THE INVENTION

The present invention-relates to a sheet refeeding device for use in an apparatus such as a printing apparatus and an electrophotographic copier by which a plurality of images are printed or copied on the front and reverse of a sheet or superimposed on one side of a sheet.

Recently, an image recording apparatus such as an electrophotographic copier can record images on both sides of a recording sheet. This kind of apparatus forms images in this manner: an image is formed on one side of a sheet in an image processing section; the sheet on which the image has been recorded is temporarily stocked; and the sheet is fed again to the image processing section so that another image can be formed on the other side. The aforementioned automatic duplex paper feeding device is disclosed in Japanese Patent Application Open to Public Inspection Nos. 82247/1984, 114227/1984, 2241/1985 and 161641/1987. In this apparatus, images are formed on both sides of a sheet in this manner: an image is formed on one side by an image forming section; the sheet is conveyed under the image forming section and temporarily accommodated in a stacker; and the sheet is conveyed upward from the stacker so that it can be fed to the image processing section again.

in an automatic composite recording device, a plurality of images are formed on one side of a sheet in this manner: a sheet, on one side of which an image has been formed by an image processing section, is accommodated in a stacker under the condition that the sheet is not reversed; the sheet is conveyed upward from the stacker; and the sheet is fed to the image processing section again.

In the case where images are continuously formed with the aforementioned apparatus on a plurality of sheets in either two-sided recording or one-sided multi-recording, the plurality of sheets on which an image has been recorded must be fed again to the image processing section one by one after all the sheets have been accommodated in the stacker.

Therefore, a long period of waiting time is required from the end of previous recording conducted continuously on a plurality of sheets to the start of a subsequent recording. For that reason, it is difficult to increase the recording speed.

SUMMARY OF THE INVENTION

It is a primary object of the present invention to provide a sheet refeeding device characterized in that: when a plurality of sheets on which images are continuously formed, are subjected to another continuous recording processing, the paper feeding operation can be conducted quickly.

The present invention is to provide a sheet refeeding device, the first structure of which will be described as follows.

In a sheet refeeding device in which a plurality of sheets on which images have been recorded are successively conveyed from a stacking means to a recording processing means,the first structure of the present invention comprises: a conveyance means which comes into contact with the lowermost sheet stacked on said stacking means and successively conveys the sheet from said stacking means; a sheet pressing means which presses or does not press the sheets on the stacking means; a first pressing control means which starts the operation of said sheet pressing means to press the sheets accommodated on said stacking means before a set number of sheets on which images are to be continuously recorded, are stacked on said stacking means; a conveyance start control means which starts the sheet conveyance operation by driving said conveyance means after the sheets have been pressed by said first pressing control means; a second pressing control means which starts again said sheet pressing means at least once to press the uppermost sheet on said stack after the sheet conveyance operation has been started according to the control of said conveyance start control means; and a conveyance control means which controls said conveyance means so that the conveyance timing of the first sheet after the pressing control conducted by said second pressing control means, can be delayed compared with the conveyance timing of other sheets, in the case where the pressing operation completion timing of said sheet pressing means with regard to sheet is later than the sheet conveyance start timing of said conveyance means.

As an example, in an electrophotographic copier in which the sheet refeeding device of the present invention is mounted, the two-sided copy mode is set, and images are to be copied on both sides of 17 sheets.

In this case, the sheets on which images have been formed by a recording processing means, are successively stacked on a stacking means installed inside the electrophotographic copier so that the sheets are not discharged out of the copier. In this case, the copied sheets are stacked on a sheet pressing means, and they are not pressed, so that they can not be positively conveyed out from the stacking means. Therefore, the first pressing control means starts the sheet pressing means at a timing, for example, when the 9th copied sheet has been stacked on the stacking means so that the first to the 9th copied sheet are pressed.

After that, for example, the conveyance start control means starts the conveyance means at a timing when the 11th sheet has been stacked on the stacking means, wherein the 11th sheet is 6 prior to the 17th sheet which is set to be the total of the continuous copying operation. Due to the foregoing, at a timing when the image has been formed on the 17th sheet, which is the last sheet, by the recording processing means, the first sheet, on the surface of which the image has already been formed, is conveyed to the position of the recording processing means, so that transfer from the front to the reverse surface recording operation can be quickly conducted. On the other hand, after the sheet conveyance operation has been started according to the control of the conveyance start control means, the second pressing control means starts the sheet pressing means at least once again so that the uppermost sheet can be pressed downward. Accordingly, the sheets which have been conveyed into the stacking means after the pressing control conducted by the first pressing control means, can be positively conveyed out from the stacking means.

When the sheets are conveyed out from the stack during the period of non-pressing condition in which the sheet pressing means changes from one pressing condition to another pressing condition, the sheets can not be positively conveyed out since the frictional force between the sheets and the conveyance roller of the conveyance means is weak. Therefore, it is necessary to stop the sheet conveyance operation performed by the conveyance means during the non-pressing period.

Accordingly, the conveyance control means controls the conveyance means so that the sheets can be conveyed out under the condition that they are always being pressed, in this manner: when the pressing operation speed of the sheet pressing means with regard to sheets is slow compared to the sheet conveyance speed of the conveyance means, the conveyance timing of the first sheet after the pressing control conducted by the second pressing control means is delayed compared with the conveyance timing of other sheets. For example, if right after the last 17th sheet has been conveyed in and the 6th sheet has been conveyed out, the second pressing control means conducts the second pressing operation, the conveyance control means delays the timing of conveyance of the 7th sheet, so that the conveyance interval between the 6th and the 7th sheet is made longer than that between other sheets. Consequently, all sheets are always conveyed out under the pressing condition.

The present invention is to provide a sheet refeeding device, the second structure of which will be described as follows.

In a sheet refeeding device in which a plurality of sheets on which images have been recorded are successively conveyed from a stacking means to a recording processing means, the second structure of the present invention comprises: a conveyance means which comes into contact with the lowermost sheet stacked on said stacking means and successively conveys the sheet from said stacking means; a sheet pressing means which presses or does not press the sheets on the stacking means; a pressing control means which starts said sheet pressing means each time a predetermined number of sheets are conveyed into said stacking means, so as to press the uppermost sheet on said stack downward; and a conveyance control means which starts said conveyance means to start the conveyance operation of the sheets, when a sheet preceding a fixed number from the last sheet in a set number of sheets to be continuously copied, is conveyed into said stacking means after at least one pressing operation has been conducted by said pressing control means.

As an example, in an electrophotographic copier in which the sheet refeeding device of the present invention is mounted, the two-sided copy mode is set, and images are going to be copied on both sides of 21 sheets.

In this case, for example, each time 7 sheets are conveyed into the stacking means, the pressing control means starts the sheet pressing means so that the uppermost sheet in the stacking means can be pressed downward. That is, each time the 7th, 14th or 21st copied sheet is conveyed into the stacking means, the sheet pressing means is started.

When at least the first pressing operation has been conducted by the pressing control means, for example, the 15th sheet, which is prior to the 21st sheet by 6, wherein 21 sheets are going to be copied in this case, is conveyed into the stacking means, the conveyance control means starts the conveyance means to convey the sheets. Then, at a time when the image has been copied on the surface of the last 21st sheet, the first sheet which has already been copied is conveyed to the position of the recording processing means, so that transfer from the front to the reverse side recording can be quickly performed. Since the pressing operation is conducted periodically as described above, every sheet is pressed when it is conveyed out. Accordingly, all sheets are positively conveyed out from the stacking means.

The present invention is to provide a sheet refeeding device, the third structure of which will be described as follows.

In a sheet refeeding device in which a plurality of sheets on which images have been recorded, are successively conveyed from a stacking means to a recording processing means, the third structure of the present invention comprises: a conveyance means which comes into contact with the lowermost sheet stacked on said stacking means and successively conveys the sheet from said stacking means; a sheet pressing means which presses or does not press the sheets on the stacking means; a first pressing control means which starts the operation of said sheet pressing means to press the sheets accommodated on said stacking means when approximately half a set number of sheets on which images are to be continuously recorded are stacked on said stack; a conveyance start control means which starts the sheet conveyance operation by driving said conveyance means when a sheet preceding a fixed number from the last sheet in a given number of sheets to be continuously copied, is stacked on said stacking means; and a second pressing control means which starts said sheet pressing means again to press the last sheet on said stacking means downward at least before the conveyance operation of said last sheet on the stacking means is started.

The difference between the first and the third structure will be explained as follows:

At least before the conveyance operation conducted on the last 17th sheet to be continuously copied is started by the conveyance means, the second pressing control means starts the sheet pressing means again so that the last 17th sheet on the stacking means is pressed downward. Consequently, the sheet which was not pressed by the control of the first pressing control means, can be positively conveyed out from the stacking means.

The present invention is to provide a sheet refeeding device, the fourth structure of which will be described as follows.

In a sheet refeeding device in which a plurality of sheets on which images have been recorded, are successively conveyed from a stacking means to a recording processing means, the fourth structure of the present invention comprises: a conveyance means which comes into contact with the lowermost sheet stacked on said stacking means and successively conveys the sheet from said stacking means; a sheet pressing means which presses or does not press the sheets on the stacking means; a sheet pressing control means which starts said sheet pressing means to press sheets each time a sheet is stacked on said stacking means when the number of sheets to be continuously copied is not more than a fixed value; and a conveyance control means which starts said conveyance means to start the conveyance operation of sheets after the sheets have been pressed by the control of said sheet pressing control means.

As an example, when the two-sided copy mode is set and the number of sheets to be copied is set to 7 in an electrophotographic copier in which the sheet refeeding device according to the invention is mounted.

In this case, the sheets, on the front surface of which images are copied by the recording processing means, are conveyed to the stacking means provided inside the apparatus and accommodated on the stacking means, so that the sheets are not discharged outside the apparatus. In this case, the sheets, on the front surface of which images are copied by the recording processing means, are stacked on the sheet pressing means so that they are not pressed. In this case where the number of sheets to be copied on both sides is 7, which is small, it is necessary to start the pressing operation when the first sheet is conveyed, in order to prepare for refeeding. Otherwise, the transfer time from the front surface copying operation to the reverse surface copying operation becomes longer than that of the conventional method. For that reason, the sheet pressing control means starts the sheet pressing means to press the sheets each time a sheet is stacked on the stacking means. That is, when the first sheet is accommodated on the stacking means, the sheet pressing means is started simultaneously. When sheets after the first sheet are accommodated on the stack, the sheet pressing means is started immediately. After the first sheet has been pressed by the control of the sheet pressing control means, the conveyance control means starts the conveyance means to convey the sheets.

At the time when image formation on the front surface of the last 7th sheet has been completed, the first sheet, on the front surface of which the image has already been formed, is conveyed to the position of the recording processing means. Accordingly, the transfer from the front surface recording to the reverse surface recording can be quickly conducted.

The present invention is to provide a sheet refeeding device, the fifth structure of which will be described as follows.

In a sheet refeeding device in which a plurality of sheets on which images have been recorded, are successively conveyed from a stacking means to a recording processing means, the fifth structure of the present invention comprises: a conveyance means which comes into contact with the lowermost sheet stacked on said stacking means and successively conveys the sheet from said stacking means; a sheet pressing means which presses or does not press the sheets on the stacking means; a first pressing control means which starts the sheet pressing means so that the first sheet to the sheet prior to a fixed number of sheets on said stacking means can be pressed when a sheet preceding the fixed number from the last sheet in a set number of sheets to be continuously copied, is stacked on the stacking means; a conveyance control means which starts the conveyance means to start the conveyance operation of the sheets right after the pressing operation by the sheet pressing means has been completed under the control of the first pressing control means; and a second pressing control means which starts the sheet pressing means again to press the last sheet on the stacking means after the last sheet has been accommodated in the stack and before the conveyance operation of the last sheet is conducted by the conveyance means.

As an example, when the two-sided copy mode is set and 15 sheets are to be copied on both sides.

For example, the first sheet pressing control means starts the sheet pressing means at a timing in which the 9th sheet, on the front surface of which the image has already been copied, is stacked on the stacking means, so that the first to the 9th sheet on the stacking means are pressed. After the pressing operation has been completed, the conveyance control means immediately starts the conveyance means, so that the sheets stacked on the stacking means are successively conveyed toward the recording processing means in such a manner that the lowermost sheet is conveyed first and the following sheets are conveyed sequentially.

At a timing in which a copying operation has been conducted on the front surface of the last 15th sheet, the first sheet, on the front surface of which the image has already been copied, is conveyed to the position of the recording processing means, so that transfer from the front surface recording to the reverse surface recording can be quickly performed.

The sheets after the 10th sheet are stacked successively on the sheet pressing means. Since they have not been pressed yet, the second pressing control means starts the sheet pressing means simultaneously when the last 15th sheet is stacked on the stacking means, so that the 15th sheet on the stacking means is pressed downward.

BRIEF DESCRIPTION OF THE DRAWINGS

FIG. 7(*b*) is a time chart of a sheet conveyance operation, wherein the second example is shown here;

FIG. 7(*c*) is a time chart of a sheet conveyance operation, wherein the third example is shown here;

FIG. 7(*d*) is a time chart of a sheet conveyance operation, wherein the fifth example is shown here;

FIG. 7(*e*) is a time chart of a sheet conveyance operation, wherein the sixth example is shown here; and FIG. 7(*f*) is a time chart of a sheet conveyance operation, wherein the seventh example is shown here.

DETAILED DESCRIPTION OF THE PREFERRED EMBODIMENTS

Referring now to the attached drawings, an example of the sheet refeeding device of the present invention will be explained as follows.

Figure 1:
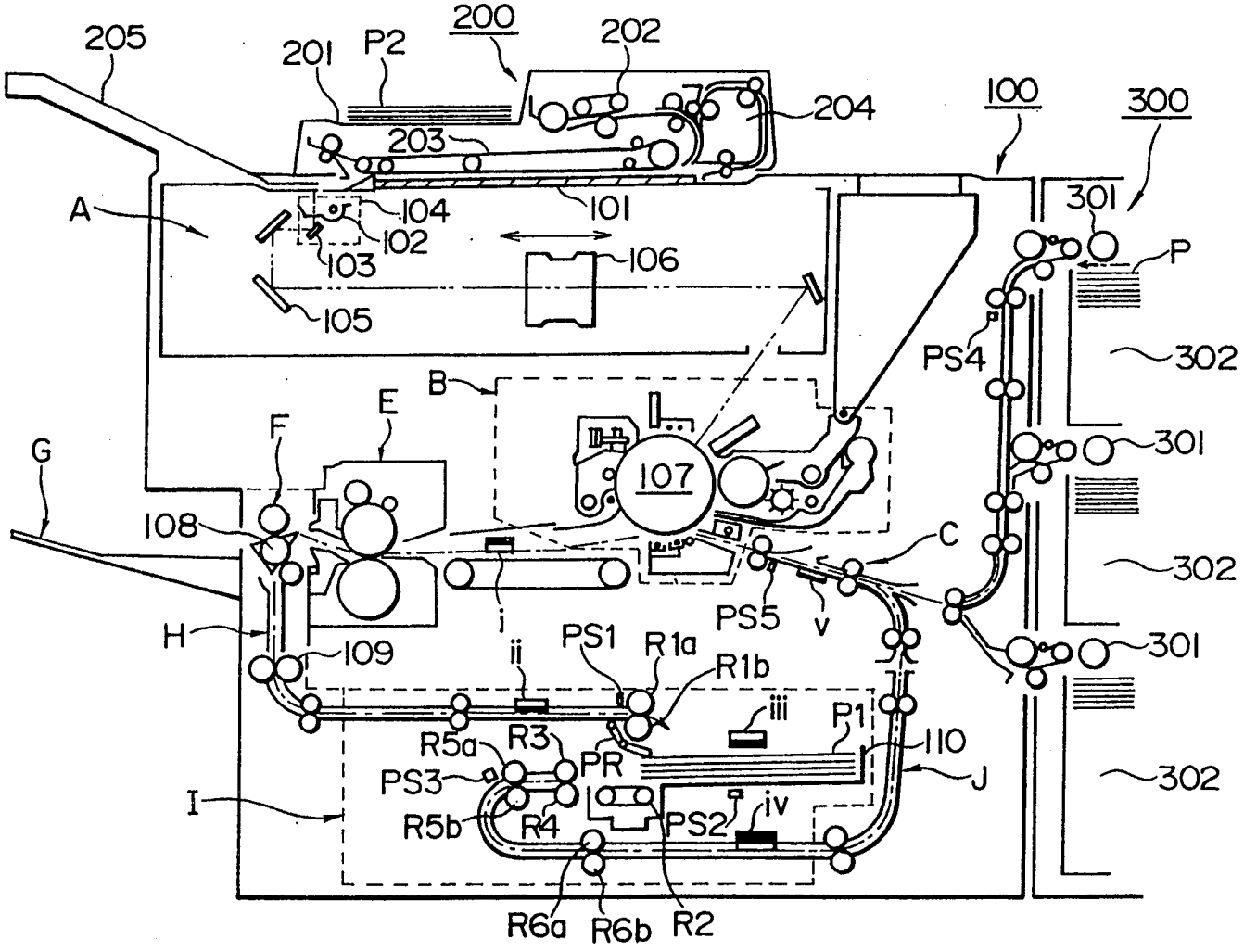
FIG. 1 is a schematic illustration showing the entire structure of an electrophotographic copier in which a sheet refeeding device of the present invention is mounted.

FIG. 1 is a schematic illustration showing the entire structure of an electrophotographic copier for which the sheet refeeding device of the present invention is utilized.

The electrophotographic copier comprises a copier main body 100, an automatic document feeder 200 which automatically conveys a plurality of documents to a predetermined position of the copier body 100, and an automatic sheet feeder 300 which automatically feeds a plurality of sheets P1 to the copier body 100 one by one. The copier 100 comprises scanning exposure section A, image forming section B, sheet feeding section C, conveyance section D, fixing section E, sheet discharging section F, discharge sheet tray G, stacker guide H, automatic reversal sheet refeeding unit (ADU) I, and intermediate conveyance section J. Sheet feeding section C, conveyance section D, sheet discharging section F, stacker guide H, automatic reversal sheet refeeding unit (ADU) I, and intermediate conveyance section J are provided with a group of rollers for conveyance use.

In FIG. 1, a one-dotted chain line shows a conveyance path of sheet P1. In the case where the two-sided mode is set, sheet P1, one side of which has already been copied, is reversed in the process of conveyance and refed to image forming section B. In the case of sheet P1, one side of which has already been copied in image forming section B, the copied surface is set upward as shown by a bold line i in FIG. 1. Then, sheet P1 is reversed while it passes through conveyance section D, sheet discharge section F and stacker guide H, and is stacked on automatic reversal sheet refeeding unit (ADU) I. (Refer to numeral ii and iii in the drawing.) Sheet P1 which has been sent out from automatic reversal sheet refeeding unit (ADU) I, is reversed again immediately. (Refer to numeral iv in the drawing.) When sheet P1 is conveyed by intermediate conveyance section J, it is reversed again. (Refer to numeral v in the drawing.) Then, sheet P1 is refed to image forming section B. After all, sheet P1 is refed to image forming section B while a surface opposite to the surface copied last time, is set to be a copying surface.

The automatic document feeder 200 is detachably provided on a platen of the copier body 100, and functions in such a manner that it reverses and conveys document P2 in accordance with the two-sided copy mode of the copier body 100. Document P2 stacked on a document tray 201, is conveyed to the platen 101 by conveyance rollers 202, and copied by the copier 100. In the case of the one-sided copy mode, document P2 is conveyed to a discharge tray 205 by a conveyance belt 203 after a predetermined number of one-sided copies has been obtained. On the other hand, in the case of the two-sided copy mode, the conveyance belt 203 is reversed synchronously when a predetermined number of copying operations have been completed by the copier body 100, and document P2 is conveyed to a reverse conveyance section 204. Document P2 is reversed in the reverse conveyance section 204, and conveyed again to the platen 101 so that the reverse side can be copied. After the reverse has been copied, document P2 is conveyed to the discharge tray 205.

The automatic sheet feeder 300 successively feeds sheets P1 to the copier body 100 one by one in this manner: the transmission of torque generated by a sheet feed motor (not shown) is turned on and off when a sheet feed clutch (not shown) is controlled; and sheet P1 is fed to the copier body 100 synchronously when document P2 is conveyed onto the platen 101 by the automatic document feeder 200. However, in the case of the two-sided copy mode, only while images are copied on the front surface of sheet P1, is sheet P1 fed to the copier body 100, and while images are copied on the reverse surface of sheet P1, sheet P1 is not supplied. Three sets of sheet feed trays 302 are provided to the automatic sheet feeder 300, and sheets P1 of different sizes can be accommodated in each of the trays.

Sheet P1 is sent into the copier body 100 by the automatic sheet feeder 300 synchronously when document P2 is conveyed onto the platen 101 by the automatic document feeder 200. The conveyance of the sheet P1 is detected by sheet fed sensor PS4. When sheet P1 is conveyed to image forming section B by sheet feed section C in the copier body 100, the conveyance of sheet P1 is detected by register sensor PS5, and scanning exposure is conducted by scanning exposure section A. That is, when a detection signal sent from resister sensor PS5 is received, a scanning system 104 including an illuminating lamp 102 and a mirror 103 is reciprocated in the direction of an arrow in scanning exposure section A, so that the entire surface of document P2 is illuminated. Then, light reflected by document P2 is introduced onto the surface of a photoreceptor drum 107 of image forming section B through a fixed mirror 105 and a lens system 106, and an electrostatic latent image is formed on the photoreceptor drum 107. The electrostatic latent image is transferred onto sheet P1.

After transfer has been completed, sheet P is conveyed by conveyance section D to fixing section E so that fixing processing is conducted on sheet P1. When the one-sided copy mode is adopted, in sheet discharge section F, a passage to automatic reversal sheet refeeding unit (ADU) I is closed by a changeover solenoid 108 so that sheet P1 is discharged onto sheet discharge tray G. When the two-sided copy mode is adopted, in sheet discharge section F, the passage to automatic reversal sheet refeeding unit (ADU) I is opened by the changeover solenoid 108 so that sheet P1, one side of which has already been copied, is conveyed to stacker introducing section H. Sheet P1 sent to stacker introducing section H is temporarily stacked on an intermediate tray 110 provided inside automatic reversal sheet feeding section (ADU) I by a group of conveyance rollers 109. Before all sheets P1 to be copied are stacked on the intermediate tray 110, in other words, in the middle of the stacking operation, automatic reversal sheet refeeding unit (ADU) I starts conveying sheets P1 in order to refeed sheets P1 stacked on intermediate tray 110 to image forming section B through intermediate conveyance section J. Then, the reverse surface of sheet P1 is copied in image forming section B. Sheets P1, on both sides of which copying operations have been conducted, are discharged to discharge tray G through conveyance section D, fixing section E and discharge section F.

Automatic reversal sheet refeeding unit (ADU) I includes the aforementioned intermediate tray 110, a sheet refeed drive system, sending mechanism, double feeding prevention mechanism, stack sensor PS3 and sheet refeed sensor PS4.

Figure 2:
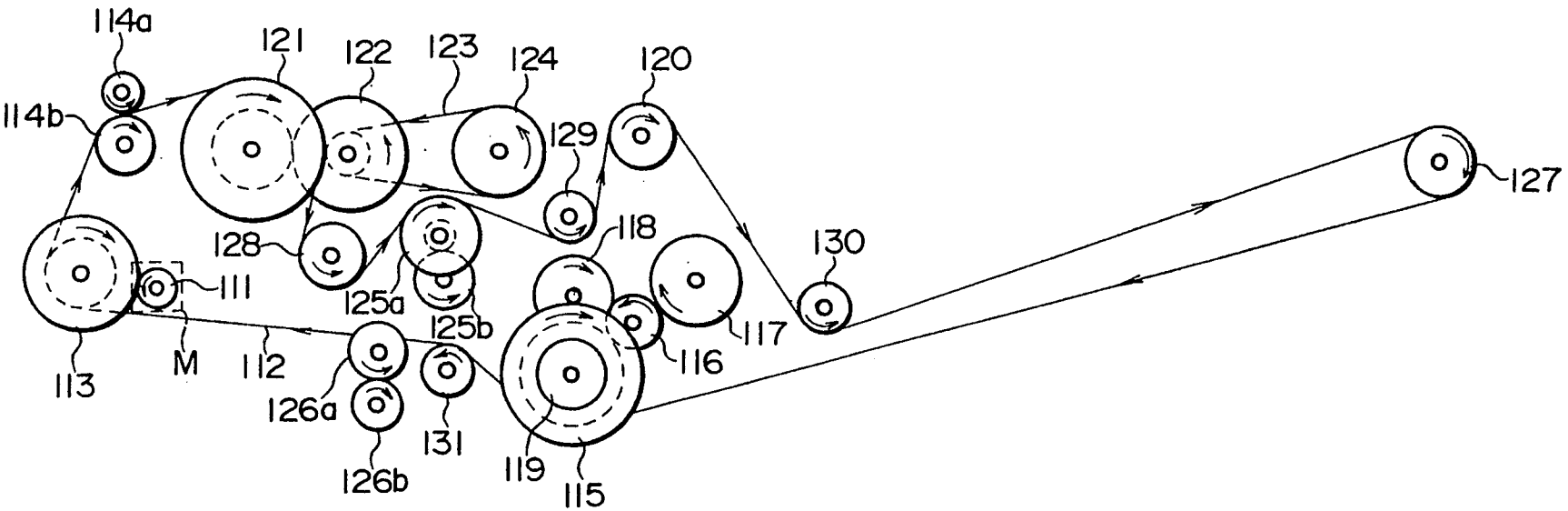
FIG. 2 is a schematic illustration showing the structure of a refeed drive system of an automatic reversal refeed unit provided in the electrophotographic copier shown in FIG. 1.

As shown in FIG. 2, the sheet refeed drive system is mounted on the side of the housing of automatic reversal sheet refeeding unit (ADU) I, and rotation of ADU drive motor M is transmitted to other gears through a gear 111 and belt 112. In the drawing, an arrow mark on each gear shows the rotating direction of the gear, and an arrow mark on the belt 112 shows the advancing direction of the belt, and further, a bold arrow mark shows the conveyance direction of sheet P1. Shafts of the gears are provided from one side of the housing to the other side, and supported by both sides of the housing. The shafts are provided with various rollers which will be described later. Rotation of ADU motor M is reduced by a reduction pulley 113 and transmitted to each gear. Rollers R1*a*, R1*b* shown in FIG. 1 are rotated by gears 114*a*, 114*b*, so that sheet P1 introduced from stacker introducing section H is conveyed to the intermediate tray 110. The aforementioned circumstances are detected by stack sensor PS1. Rotation of gear 115 is transmitted through gear 116 to gear 117 rotating sending roller R2 shown in FIG. 1, and also transmitted to gear 118 rotating conveyance roller R4 below double feeding prevention roller R3. The shaft of the gear 115 is also provided with a sheet refeeding clutch 119, and only when the sheet refeeding clutch 119 is turned on, the aforementioned sending rollers R2 and conveyance roller R4 can be rotated. A gear 120 is provided for the purpose of rotating sheet pressing member PR shown in FIG. 1. This sheet pressing member PR will be explained in detail later.

Rotation of motor M is transmitted to a reduction gear 122 for double feeding prevention use through a gear 121. The reduction gear 122 for double feeding prevention use reduces the rotation of motor M, and transmits the rotation to a gear 124 for double feeding prevention use through a belt 123. The gear 124 for double feeding prevention use rotates double feeding prevention roller R3 in the direction opposite to that of conveyance roller R4 which is disposed below double feeding prevention roller R3. Gears 125*a* and 125*b* rotate rollers R5*a* and R5*b*, so that sheet P1, which has been sent out from the intermediate tray 110, is conveyed and handled. These conveyance circumstances, that is, the sheet refeeding circumstances are detected by sheet refeeding sensor PS3. Gears 126*a* and 126*b* rotate conveyance rollers R6*a* and R6*b* shown in FIG. 1 which convey sheet P1 reversed again after that. A gear 127 is utilized for aligning sheets P1 so that sheets P1 collide with the inner wall (the right wall shown in Fig. 1) of the intermediate tray 110. Numerals 128–131 are idlers. When rotation of motor M is transmitted to various rollers through belts and gears, various operations are easily synchronized, as well as the number of power sources can be reduced.

Figure 3:
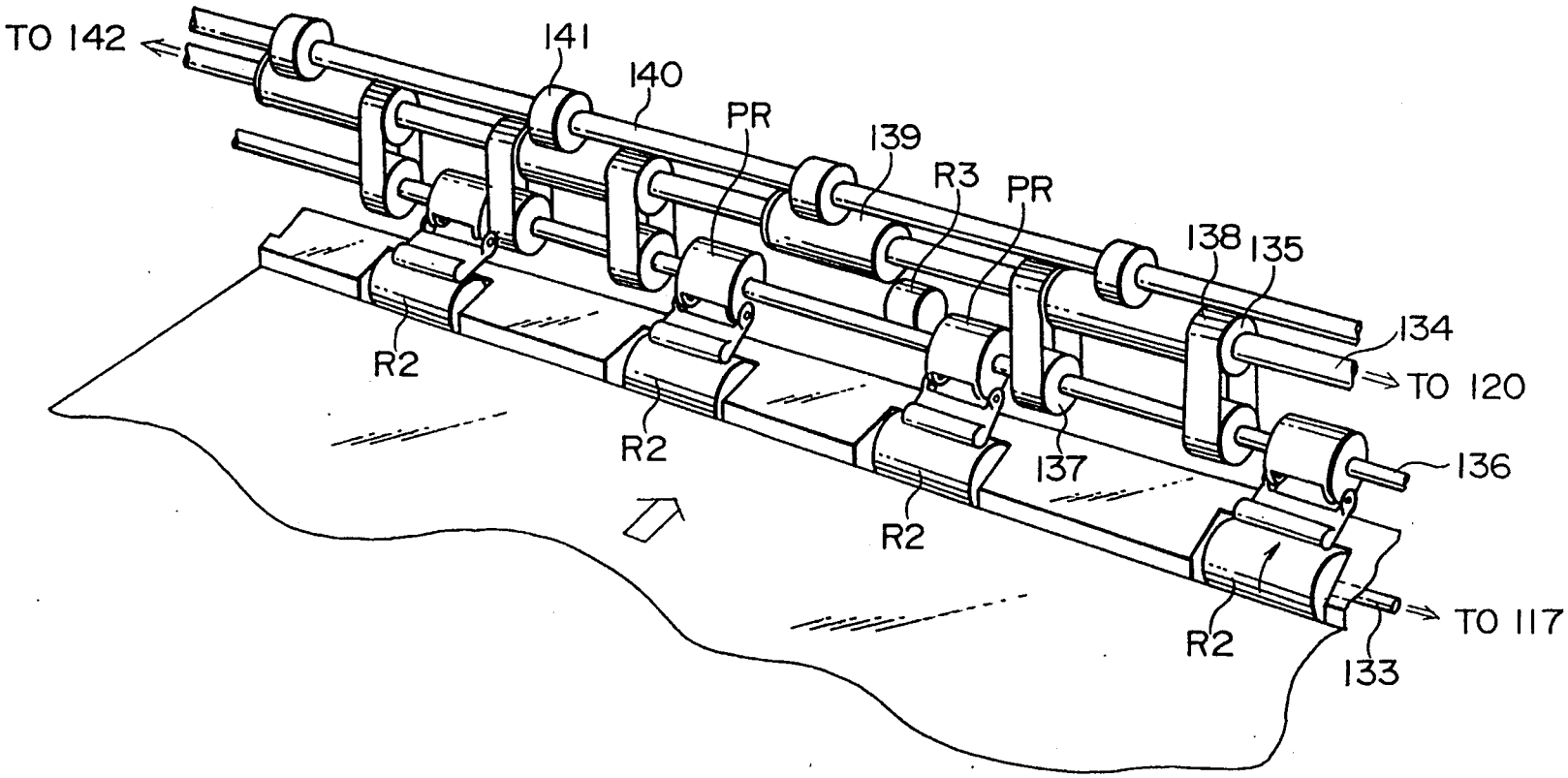
FIG. 3 is a perspective view showing the structure of a conveyance mechanism of the automatic reversal refeed unit.

FIG. 3 is a perspective view of the sending-out mechanism. Sending roller R2 is mounted on a shaft 133 of the aforementioned gear 117. When sending roller R2 is rotated in the direction of an arrow, the lowermost sheet P1 in the intermediate tray 110 is successively sent out in the direction of a bold arrow mark. Rollers 135 are mounted on a shaft 134 of the aforementioned gear 120 at regular intervals, and rollers 137 are mounted on a shaft 136 right below the shaft 134 at positions corresponding to the rollers 135. The rollers 135 and 136 are connected with each other by a belt 138. Accordingly, rotation of the aforementioned gear 120 is transmitted to the roller 137. The shaft 136 is provided with sheet pressing member PR as well as the roller 137. Accordingly, when sheet pressing member PR is rotated in accordance with the rotation of the roller 137, it presses sheet P1 downward so as to help sending roller R2 to convey out the sheets. A wide rubber roller 139 mounted on the shaft 134 and a roller 141 mounted on a shaft 140 right above the shaft 134 are contacted with each other, and a one-revolution-clutch-mechanism 142 is provided on the tip of the shaft 134. When the rotation of the shaft 140 is restricted by the one-revolution-clutch-mechanism 142, the rotation of sheet pressing member PR is controlled through the roller 141, roller 139, belt 138, and roller 137.

Figure 4:
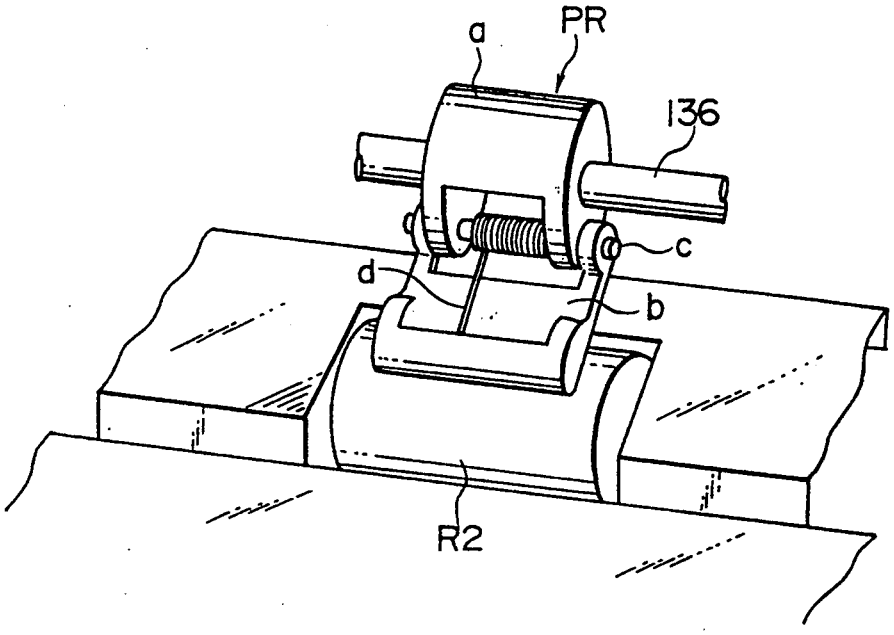
FIG. 4 is an enlarged perspective view of a sheet pressing member.
Figure 5A:
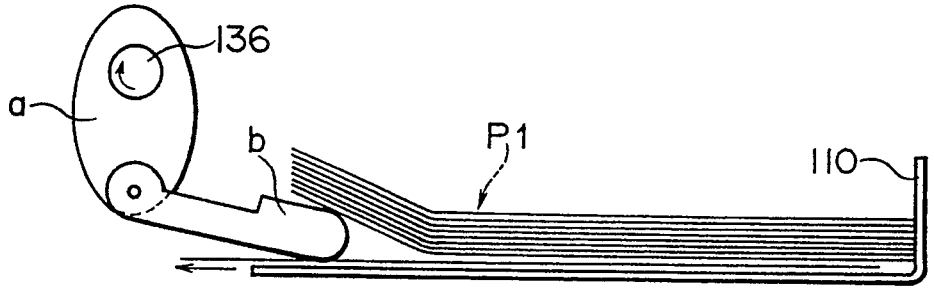
FIGS. 5(*a*), 5(*b*) and 5(*c*) are schematic illustrations explaining the progress of rotation of the sheet pressing member.
Figure 5B:
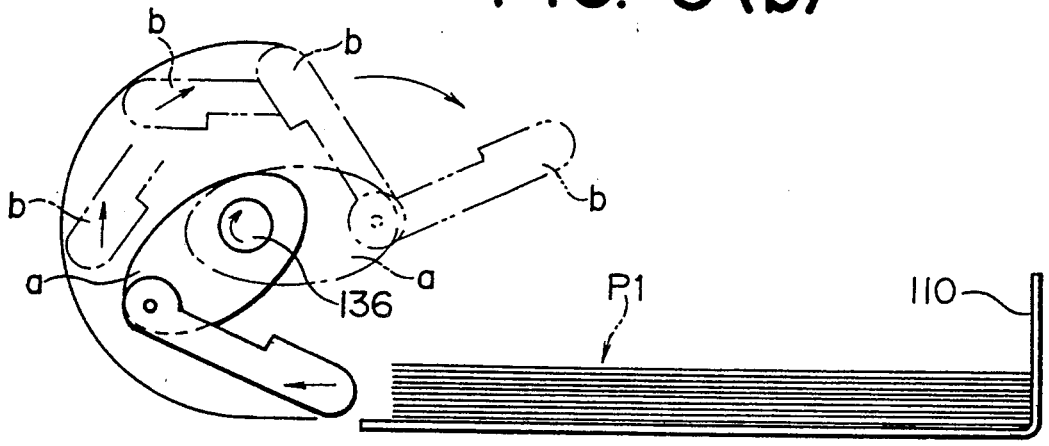
Figure 5C:
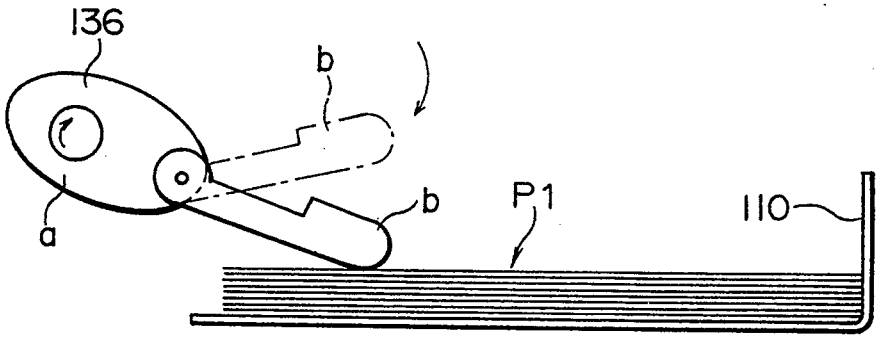

FIG. 4 is an enlarged perspective view of sheet pressing member PR. Sheet pressing member PR includes rotating member a and arm member b, and rotating member a is fixed to a shaft 136. Rotating member a and arm member b are connected with each other through pin c by a hinge connection. Rotating member a and arm member b are pushed to each other by helical spring d so that they can extend straight. When the shaft 136 (roller 137) is rotated, rotating member a and arm b are integrally rotated. The reason the aforementioned rotation is conducted is that usually, in the initial condition, arm member b is located on the bottom of the intermediate tray 110, and sheets P1 are stacked on arm b, so that arm b does not press sheets P1 downward. In order to help sending roller R2 to send out sheets, arm member b is rotated so as to press sheets P1 stacked on the intermediate tray 110. That is, when sheet pressing member PR is rotated, it is put under the following conditions. If arm b comes into contact with the bottom of the intermediate tray 110, sheets P1 are stacked on arm member b as shown in FIG. 5(*a*). Under this condition, stacked sheets P1 are not pressed downward, so that the frictional force between sheet P1 and sending roller R2 is weak. Accordingly, it is difficult to send out the sheets by sending roller R2. Therefore, sheet pressing member PR is rotated, and then arm b leaves from the bottom of the intermediate tray 110 and withdraws in the direction of sheet conveyance as shown in FIG. 5(*b*). Finally, arm b moves onto the intermediate tray 110 as shown in FIG. 5(*c*), and presses stacked sheets P1. Since the frictional force between sheet P1 and sending roller R2 is strong under the aforementioned condition, sending roller R2 can easily send out sheet P1. As described above, sheets are refed during a stacking operation, and the aforementioned rotation of sheet pressing member PR is conducted before completion of the stacking operation.

Figure 6:
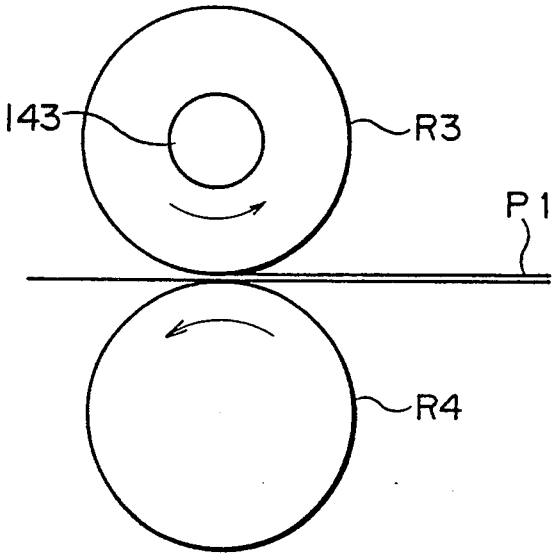
FIG. 6 is a schematic illustration showing a model of the sheet double feeding prevention mechanism of the automatic reversal refeed unit.

FIG. 6 is a schematic illustration showing a model of double feeding prevention mechanism. When a plurality of sheets P1 are sent out by sending roller R2, the double feeding prevention mechanism separates the sheets one by one. Double feeding prevention roller R3 is disposed right above conveyance roller R4 with a small gap formed between the two rollers. Conveyance roller R4 is rotated in the direction indicated by an arrow mark so that sheet P1 which has been sent out by sending roller R2 can be successively conveyed in the same direction. On the other hand, double feed prevention roller R3 is rotated so that sheet P1 can be moved in the reverse direction in order to prevent the conveyance of upper sheet P1. Accordingly, sheets P1 are conveyed one by one by conveyance roller R4. Incidentally, a torque limiter 143 is connected with double feeding prevention roller R3. Therefore, only when a plurality of sheets P1 are sent out by sending roller R2, is double feeding prevention roller R3 rotated.

Figure 7A:
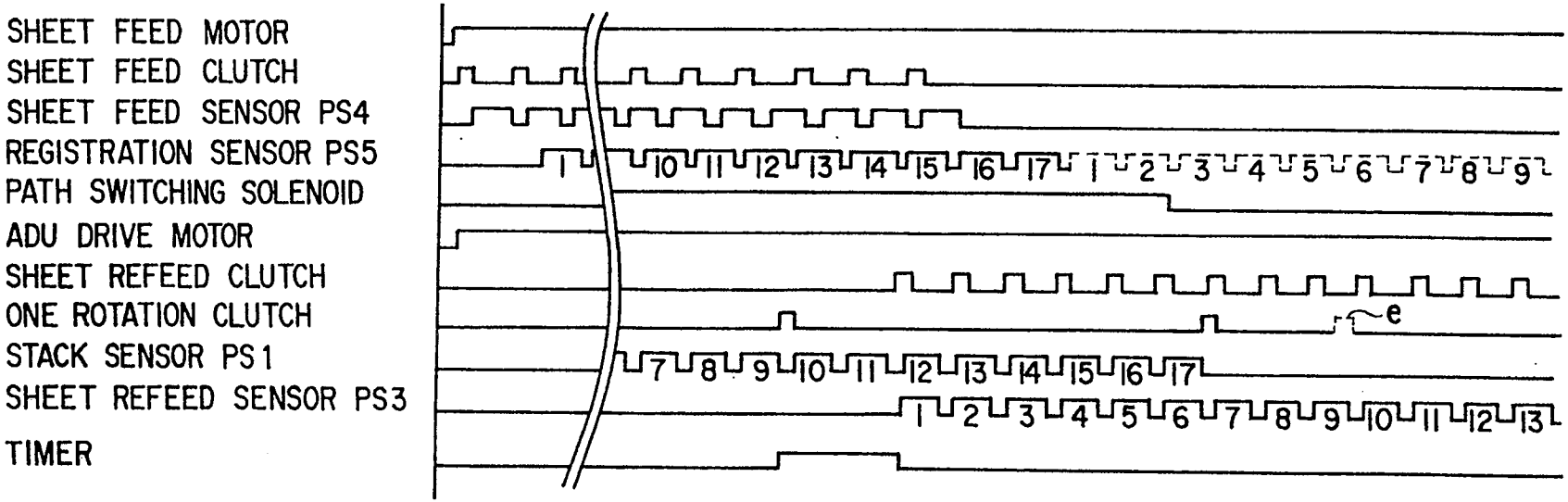
FIG. 7(*a*) is a time chart of a sheet conveyance operation, wherein the first and the fourth example are shown here.
Figure 7:
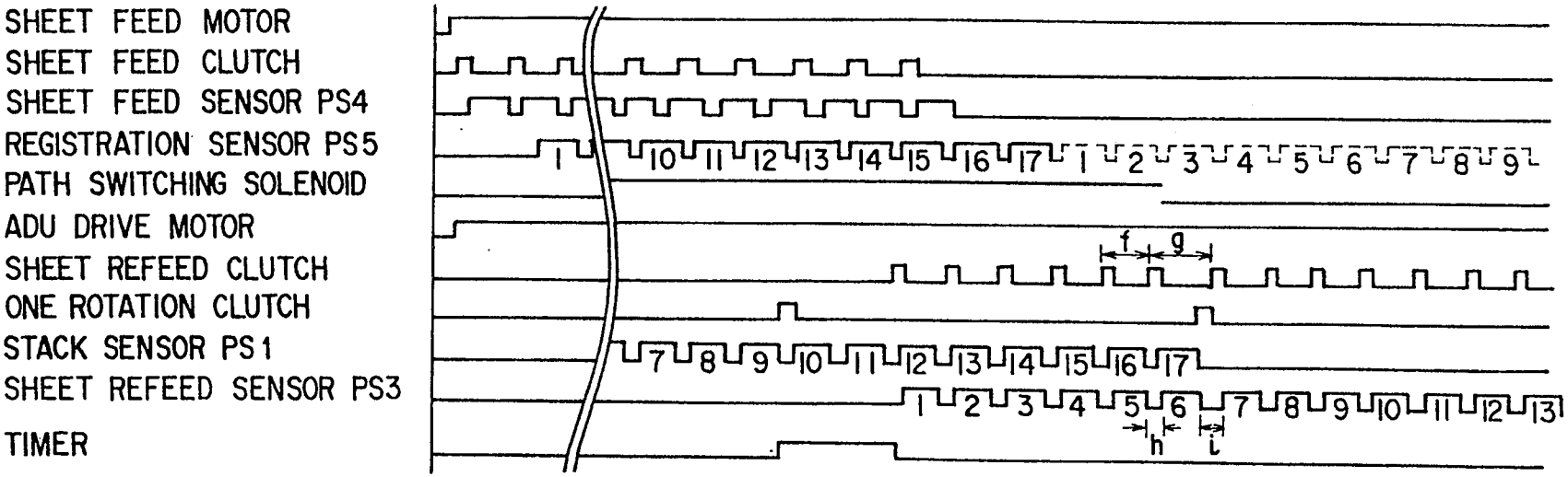
Figure 7C:
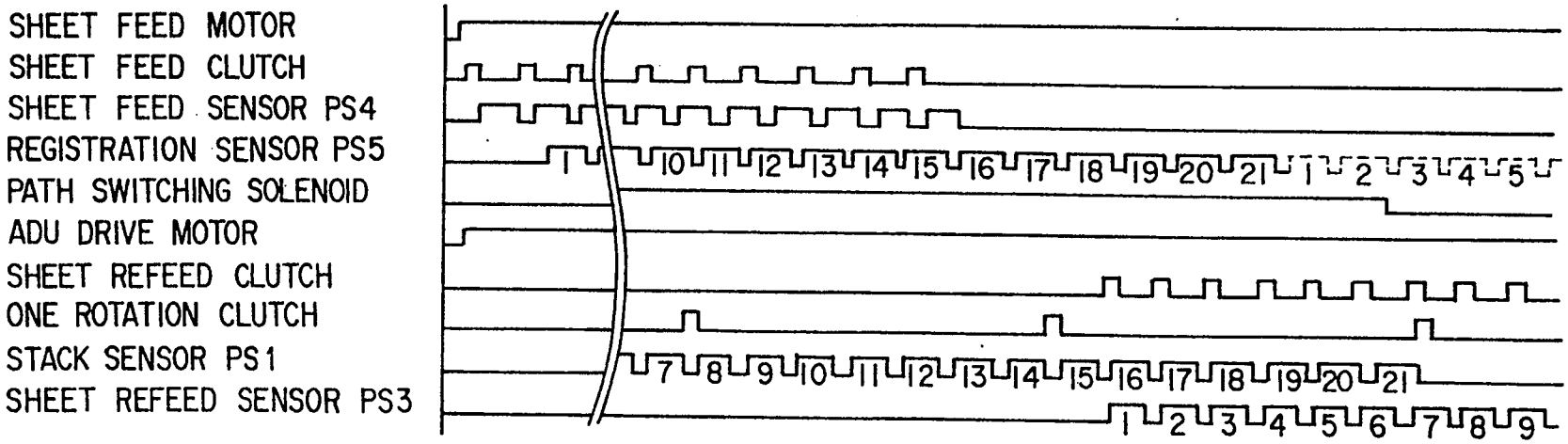
Figure 7D:
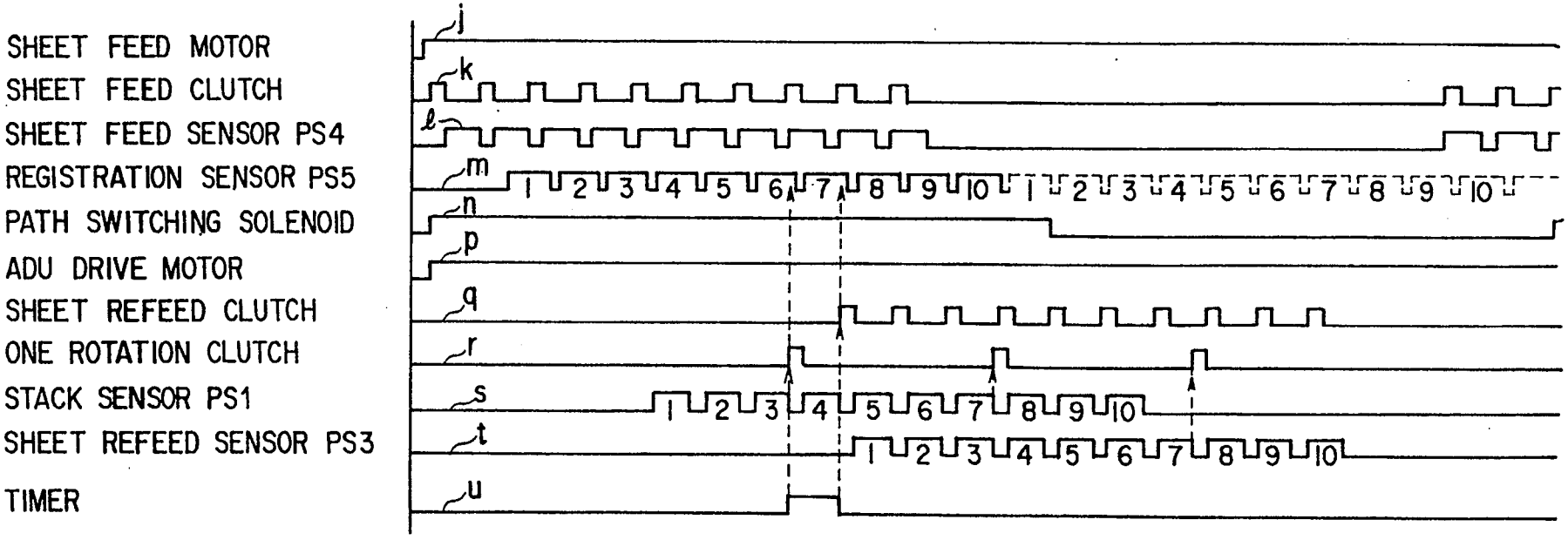
Figure 7E:
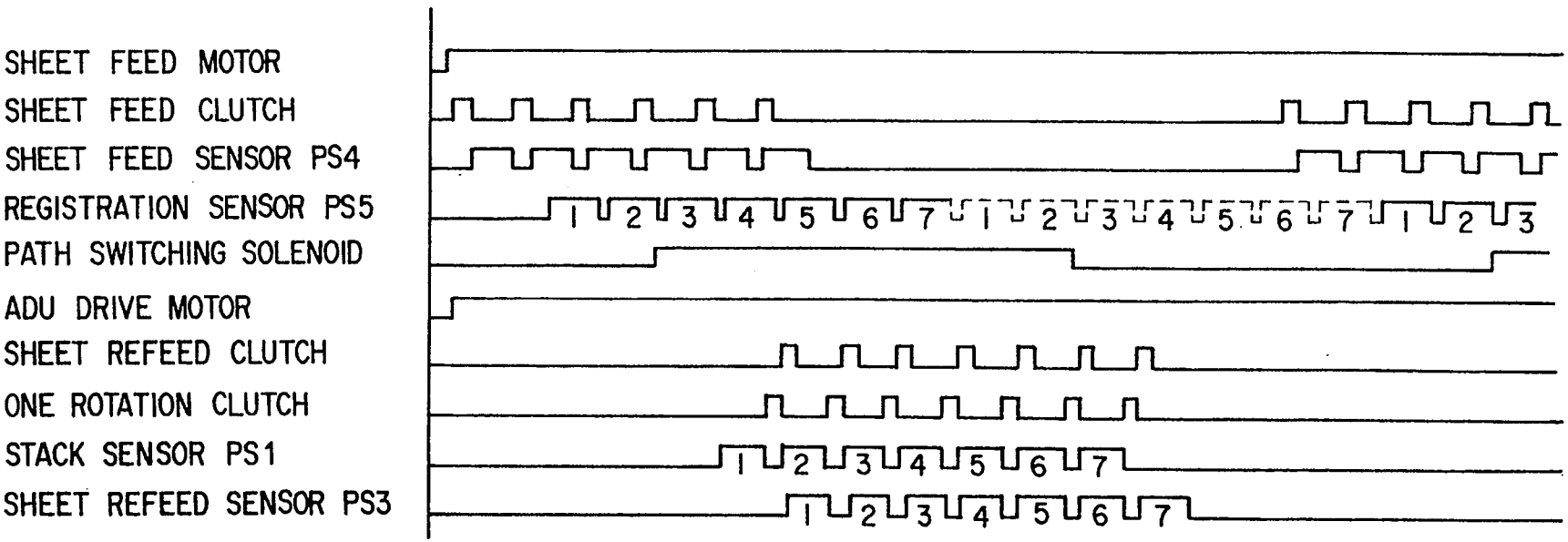
Figure 7:
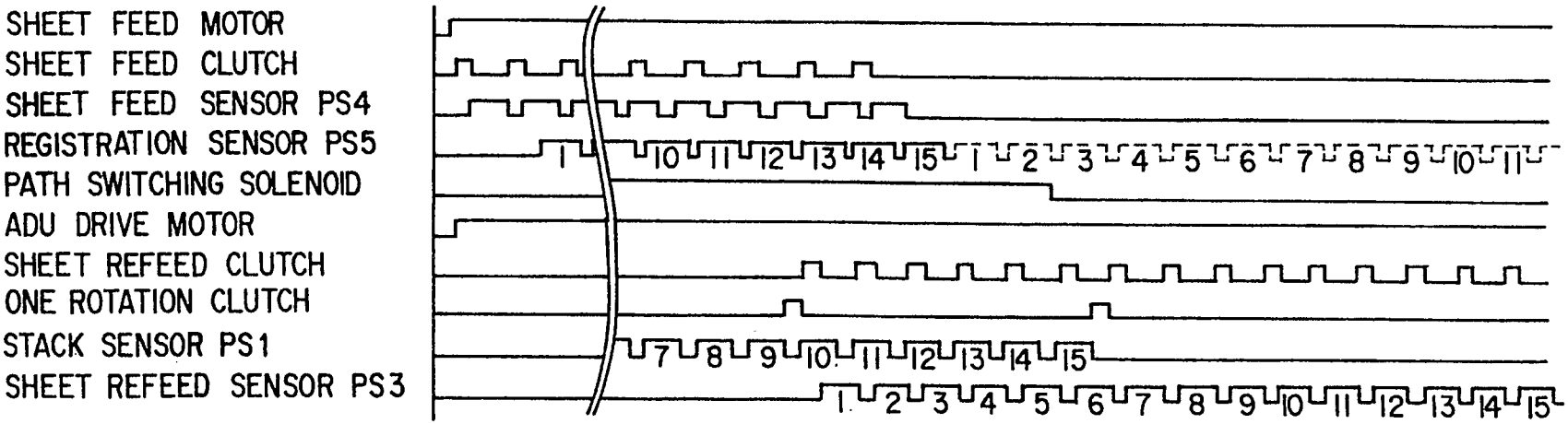

Referring to FIG. 7(*a*), the first example of sheet conveyance operation in case of two-sided copy mode will be explained as follows. In this example, 17 sheets P are subjected to two-sided copy processing, and the numerals shown in the drawing are used to identify each sheet P1.

As shown in FIG. 7(*a*), after the two-sided copy mode and the number of sheets to be copied on two sides have been set, the sheet feed motor of the sheet feed unit 300 and ADU drive motor M of the copier body 100 are started simultaneously when the start switch is turned on. A sheet feed clutch is turned on for a period of time corresponding to the sheet size at predetermined intervals, so that a plurality of sheets P1 are continuously supplied to the copier body at predetermined intervals. The aforementioned sheet feed circumstances are detected by sheet feed sensor PS4. When a sheet is conveyed to a predetermined position of image forming section B by conveyance section C provided in the copier body, the conveyed sheet is detected by register sensor PS5. Sheet P1, one side of which has already been copied by image forming section B, is conveyed to sheet discharge section F through fixing section E. At this time, the passage changeover solenoid 108 of sheet discharge section F is turned on, so that sheet P1 is conveyed to automatic reversal sheet feeding unit (ADU) I. Then, the sheets are successively stacked on the intermediate tray 110 of automatic reversal sheet feeding unit (ADU) I through stacker guide H. At this time, the first sheet P1 is stacked in the lowermost position, and the following sheets P1 are stacked on the first sheet. In this stage, sheet pressing member PR does not press sheets P1 yet. The number of sheets stacked on the intermediate tray 110 is detected by stack sensor PS1.

In order to start a reverse side copy operation immediately after a front side copy operation has been completed, the following preparation work is conducted. First, when stack sensor PS1 detects that 9 sheets have been stacked on the tray, the one-revolution-clutch-mechanism 142 is turned on to rotate sheet pressing member PR so that the first - the 9th sheet P1 on the intermediate tray 110 are pressed, and at the same time, the timer is turned on. When the timer is turned off, the refeeding clutch 119 is intermittently turned on so that sending roller R2 is intermittently rotated. That is, sheets P1, one side of which has been already copied, are successively sent out at predetermined intervals. Then, the front side copy operation is transferred to the reverse side copy operation at the same interval as that of the front side copy operation. That is, the front side recording operation can be quickly changed to the reverse side recording operation. Incidentally, sheet P1 sent out from the intermediate tray 110 is detected by sheet refeeding sensor PS3.

At a time when stack sensor PS1 detects that the last 17th sheet has been stacked, sheet P1 from the 10th—the 17th, which were stacked after the first rotating operation of sheet pressing member PR, are not pressed yet. In order to prepare for conveyance of these sheets, the one-revolution-clutch 142 is turned on again so that the 17th sheet P1 can be pressed downward. That is, when sheet pressing member PR is rotated only twice, all sheets P1 can be surely sent out while the sheets are pressed. It is necessary for sheet P1 to be sent out from the intermediate tray 110 under the condition that the sheet is pressed. Consequently, as shown by "e" in FIG. 7(*a*), the timing at which the one-revolution-clutch 142 is turned on for the second time, may be set in a period time from the stacking operation of the last 17th sheet to the starting operation of the lowermost 10th sheet which is not pressed.

In order to smoothly transfer from the front side copy operation to the reverse side copy operation, it is very important to control the timing of intermittently turning on the sheet refeeding clutch 119, that is, the starting timing of sheet refeeding operation. Therefore, the starting timing of sheet refeeding operation will be explained as follows.

The starting timing of sheet refeeding operation is restricted by the copy speed of image forming section B and the conveyance time from the intermediate tray 110 to registration sensor PS5. That is, the faster the copy speed of image forming section B is, or the longer the conveyance time from the intermediate tray 110 to registration sensor PS5 is, the earlier the start timing of sheet refeeding operation must be. In other words, the time limit of the start of sheet refeeding operation is determined in accordance with the specification of the apparatus such as the aforementioned copy speed and required time, that is, the time limit is determined in such a manner that a time at which a predetermined ordinal number of sheet P1 has been stacked, is used as the time limit.

Next, referring to FIG. 7(*b*), the second example of conveyance operation in the two-sided copy mode will be explained as follows. Many operations in this example are the same as those in the example shown in FIG. 7(*a*), so that only different points will be explained.

In the second example shown in FIG. 7(*b*), the period of time in which the one-revolution-clutch 142 is turned on, is longer than the period of time in which the sheet refeeding clutch 119 is turned on. In other words, that is a case in which the rotating speed of sheet pressing member PR is slower than the conveyance speed of sending roller R2.

In the period of time from when arm member b of sheet pressing member PR starts rotating from the position at which it presses sheets P1, to when arm member b presses sheets P1 next time, sheet P1 are left in a non-pressing condition as shown in FIG. 5(*a*)–5(*c*). When a sheet conveyance operation is conducted while arm member b is being rotated, that is, while the sheets are not pressed, the frictional force between the lowermost sheet P1 and sending roller R2 is so weak that sheet P1 can not be sent out positively. Therefore, in this example, while arm member b is being rotated, all the operations of sheet conveyance are stopped, in other words, all sheets are conveyed out under the condition that they are being pressed. For that reason, the following control is conducted.

When the one-revolution-clutch 142 is turned on, that is, when arm member b is rotated for the second time, the operation of the sheet refeeding clutch 119 is stopped. When the one-revolution-clutch 142 has been turned off and the rotating motion of arm member b has been completed, the next operation of the sheet refeeding clutch 119 is started. That is, in the case where the one-revolution-clutch 141 is turned on for the second time, the timing (refer to g) at which the sheet refeeding clutch 119 is turned on next time is delayed as compared with other ON-timing (refer to f) of the sheet refeeding clutch 119, so that the sheet refeeding clutch 119 can be turned on when the one-revolution-clutch 142 is turned off. Due to the foregoing, the conveyance interval between the 7th sheet P1 which is sent out right after the second 0N of the one-revolution-clutch 141, and the 6th sheet P1 which was sent out before that, becomes longer than the conveyance interval of other sheets P1 (refer to i and h).

As can be seen from FIG. 7(*b*), when the one-revolution-clutch 141 is turned on for the first time, the sheet refeeding operation is started after the rotating operation has been completed even though the rotating speed of sheet pressing member PR is low. Consequently, delay control which is conducted in the case of the second ON operation, is not necessary in the first ON operation.

The present invention is not limited to the aforementioned first and second example. For example, the present invention can be applied to a case in which sheet pressing member PR is rotated not less than 3 times. In this case, the timing is delayed right after the third rotation in the same manner as the second rotation shown in FIG. 7(*b*). Further, the present invention is not limited to a recording apparatus which conducts recording on both sides of a sheet. It is possible to apply the present invention to a recording apparatus which conducts recording on one side of a sheet a plurality of times.

Next, referring to FIG. 7(*c*), the third example of the sheet conveyance operation in the two-sided copy mode will be explained as follows. In this example, the number of sheets P1 to be copied on sides is 21, and numerals shown in the drawing are to identify each sheet P1.

Operations shown in FIG. 7(*c*) which are different from those shown in FIG. 7(*a*) will be described as follows.

In order to transfer to the reverse side copying operation right after the front side copying operation has been completed, the following preparing operations are conducted:

First, when stacking sensor PS1 detects the conveyance of the 7th sheet P1, the one-revolution-clutch 142 is turned on so that sheet pressing member PR is rotated, and the first—the 7th sheet P1 stacked on the intermediate tray 110 are pressed. However, sheets P1 which are conveyed onto the tray after the aforementioned pressing operation, are stacked on arm member b, so that they are not pressed. Therefore, when the 14th and 21st sheet P1, wherein numerals 14 and 21 are multiples of numeral 7, are conveyed onto the tray, the one-revolution-clutch 142 is turned on in the same manner so that sheet pressing member PR is rotated, and the uppermost sheet P1, which is the 14th of 21st sheet, is pressed downward.

When the pressing operation is conducted periodically as mentioned above, the number of sheets P1 stacked on arm member b of sheet pressing member PR can be maintained not to be too much. Due to the foregoing, the frictional force between arm member b and sheet P1 can be maintained within a predetermined range, so that the difference of torque can be maintained almost uniform and smooth rotation can be realized, and at the same time, damage of sheet P1 caused by a frictional force can be prevented, and misalignment of sheets P1 can be also prevented. The aforementioned periodical pressing operation is effective when the number of continuous copying is appropriate, and the specific number depends on the specification of an apparatus.

Next, when stacking sensor PS1 detects that the 15th sheet, which is prior to the 21st sheet by 6, has been conveyed onto the intermediate tray 110, a refeeding operation which sends sheet P1 from the intermediate tray 110 to image forming section B, is started when the sheet refeeding clutch 119 is turned on intermittently. Then, the first sheet, the front side of which was already copied, is conveyed to a position of the recording processing means at a timing in which the front side of the last 21st sheet has been copied. Therefore, the front side copying operation can be transferred to the reverse side copying operation at the same interval as that of front side continuous copying operation. That is, the transfer from the front side copying operation to the reverse side copying operation can be conducted quickly. Since the pressing operation can be conducted periodically as described above, every sheet is pressed when it is sent out, so that the sheet can be positively conveyed out from the stacking means.

Next, referring to FIG. 7(*a*), the fourth example of sheet conveyance operation in the two-sided copying mode will be explained as follows. In the same manner as the first example, the number of sheets P1 to be copied on both sides is 17, and numerals in the drawing are to identify each sheet P1.

In the fourth example, the following points are different from the first example shown in FIG. 7(*a*).

In order to transfer to the reverse side copying operation right after the front side copying operation has been completed, the following preparing operations are conducted:

First, when stacking sensor PS1 detects the conveyance of the 9th sheet P1, the one-revolution-clutch 142 is turned on so that sheet pressing member PR is rotated, and the first—the 9th sheet P1 stacked on the intermediate tray 110 are pressed, and at the same time the timer is started.

The ordinal number of sheet P at which the aforementioned first rotation of sheet pressing member PR is conducted, can be found by the following formula where the number of sheets to be copied on both sides is N.

[Formula 1 ]

$$\{INT(N/2)+1\}$$

where INT is an integer portion of N/2. As can be seen from the formula, when approximately half the number of sheets to be copied continuously have been stacked, the first rotation is conducted. As described above, in the case where the number of sheets to be continuously copied is 17, when approximately half the number of sheets have been stacked, the first rotation is conducted. Therefore, increase of the number of sheets P1 stacked on arm member b of sheet pressing member PR, can be restricted. In the manner described above, the frictional force between arm member b and sheet P1 can be maintained in a predetermined range, so that the difference of torque between the initial stage of rotation in which arm member b is coming into contact with the bottom portion of the intermediate tray 110, and the stage after that, becomes small, and smooth rotation of sheet pressing member PR can be realized, and at the same time, damage of sheet P1 which is contacted with arm member b can be prevented. Incidentally, the first rotating operation which is conducted at a timing in which half the number of sheets to be continuously recorded have been stacked, is effective when the number is in a relatively small range, and its specific range depends on the specification of the apparatus.

When the timer is turned off, the sheet refeeding clutch 119 is intermittently turned on, and then, a sheet refeeding operation is started in such a manner that: sheets P1 on the intermediate tray 110, one side of which has been already copied, are successively conveyed out from the tray, wherein the lowermost sheet is conveyed out first. In this case, the front side copying operation is transferred into the reverse side copying operation at the same interval as that of the continuous copying operation conducted on the front surface. That is, the front side recording operation can be quickly shifted to the reverse side recording operation. Incidentally, sheet P1 sent out from the intermediate tray 110 is detected by sheet refeeding sensor PS3.

Next, referring to FIG. 7(*d*), the fifth example of sheet conveyance operation in the two-sided copying mode will be explained as follows. The number of sheets P1 to be copied on both sides is 10, and numerals in the drawing are to identify each sheet P1.

As shown by j and p in FIG. 7(*d*), after the two-sided copying mode has been set, the motor of the sheet feeding unit 300 and ADU drive motor M of the copier body 100 are started concurrently when the start switch is turned on. The sheet feeding clutch is turned on for a period of time required according to the sheet size at predetermined time intervals, so that a plurality of sheets P are continuously supplied to the apparatus body at predetermined time intervals. (Refer to k.) These sheet feeding circumstances are detected with sheet feeding sensor PS4. When the sheet is conveyed to a predetermined position in image forming section B by conveyance section C, the conveyance is detected by register sensor PS5. (Refer to m.) Sheet P1, one side of which has been copied in image forming section B, is conveyed to sheet discharge section F through fixing section E. At this time, the passage changeover solenoid 108 in sheet discharge section F is turned on (refer to n), so that sheet P1 is conveyed to automatic reversal sheet refeeding unit (ADU) I. Then, sheets P1 are successively stacked on the intermediate tray 110 of automatic reversal sheet refeeding unit (ADU) I through stacker guide H. In this case, the first sheet P1 is stacked in the lowermost portion, and the second sheet and after-second sheets are stacked on the lowermost sheet. In this stage, sheet pressing member PR does not press sheet P1 yet. The number of sheets stacked on the intermediate tray 110 is detected with stacking sensor PS1. (Refer to s.)

In order to transfer to the reverse side copying operation right after the front side copying operation has been completed, the following preparing operations are conducted:

First, while the front side of the 6th sheet is being copied, that is, when stacking sensor PS1 detects that 3 sheets have been stacked (refer to m and s), the one-revolution-clutch 142 is turned on (refer to r) so that the first to the third sheet stacked on the intermediate tray 110 are pressed by sheet pressing member PR, and at the same time, the timer is started. When the timer is turned off, the sheet refeeding clutch 119 is intermittently turned on (refer top g) so that sheet P1 stacked on the intermediate tray 110, one side of which has already been copied, are successively sent out. Sheet P1 sent out from the intermediate tray 110 is detected with sheet refeeding sensor PS3 (refer to t).

At a point of time in which the third sheet has been sent out from the intermediate tray 110, the 4th to the 7th sheet stacked on the intermediate tray 110 are not pressed yet. Accordingly, in order to send these sheets, the one-revolution-clutch 142 is turned on concurrently when the third sheet has been sent out from the intermediate tray 110, so that the 4th to 7th sheets can be sent out. (Refer to r and t.) From the same reason, in order to press the 8th to 10th sheet which have been stacked after that, the one-revolution-clutch 142 is turned on concurrently when the 7th sheet has been sent out from the intermediate tray 110. (Refer to r and t.) That is, after the one-revolution-clutch 142 was turned on for the first time, it is turned on each time 4 sheets are stacked on the intermediate tray. As a result, as can be seen from m in FIG. 7(*d*), the front side copying operation can be transferred to the reverse side copying operation at the same interval as that of the front side copying operation.

As can be seen from the foregoing, in order to smoothly transfer from the front side copying operation to the reverse side copying operation, it is important to control the timing of the first revolution of the one-revolution-clutch 142, and the timing of start of intermittent turning-on operation of the sheet refeeding clutch 119. That is, it is important to control the timing of start and stop of the timer. Therefore, the start and stop timing of the timer will be explained as follows.

Start timing of the timer is determined by the difference between the conveyance time from the automatic sheet feeding unit 300 to register sensor PS5, and the conveyance time from the intermediate tray 110 to register sensor PS5. That is, in the case where the conveyance time from the automatic sheet feeding unit 300 to register sensor PS5 is longer than the conveyance time from the intermediate tray 110 to register sensor PS5, the timing to start the timer must be advanced. Accordingly, it is required to start the timer at a point of time in which more previous sheets are copied on the front surface.

Timing to stop the timer is determined in accordance with a period of time required to reverse a document with the automatic document feeder 200. In the case where the period of time required to reverse a document is shorter than the time interval of sheet conveyance in a continuous copying operation, the time interval between the last sheet of front side copying and the first sheet of reverse side copying can be made the same as the time interval of sheet conveyance in a usual continuous copying operation.

In order to transfer from the front side copying operation to the reverse side copying operation smoothly, the time limit of the first pressing operation of the one-revolution-clutch 142 is at a point of time when sheet P1, the ordinal number of which is a predetermined value, has been stacked, and the time limit is determined according to the specification of the apparatus.

Next, referring to FIG. 7(*e*), the 6th example of the sheet conveyance operation in the two-sided copying mode will be explained as follows. In this example, the number of sheets P1, both sides of which are to be copied, is 7. Many points are common between this example and the aforementioned 5th example, so that only different points will be briefly explained.

In the case where the number of sheets P1, both sides of which are to be copied, is 7, at a timing in which the first sheet P1, one side of which has already been copied, is stacked on the intermediate tray 110, resister sensor PS5 detects sheet P1 not copied yet which is the third sheet from the last. Unless the pressing operation is not performed at this timing, it is not possible to smoothly transfer from the front side copying operation to the reverse side copying operation. Accordingly, when the first sheet P1, one side of which has already been copied, is detected by stacking sensor PS1, the one-revolution-clutch 142 is immediately turned on. Then, concurrently when the one-revolution-clutch 142 has been turned off and the pushing operation against the first sheet P1 has been completed, the sheet refeeding clutch 119 is intermittently turned on, so that sheets P1 on the intermediate tray 110, one side of which has already been copied, are successively conveyed out in the order from the bottom to the top.

When the second sheet and the sheets after the second are detected by stacking sensor PS1, the one-revolution-clutch 142 is turned on each time of the detection in order to refeed each sheet under a pressing condition. When the number of sheets P1 to be copied on both sides, is small, each time sheet P1, one side of which has already been copied, is stacked on the intermediate tray 110, the one-revolution-clutch 142 is turned on, so that sheet P1 is refed one by one under a pressing condition.

Incidentally, in the case where the number of sheets to be copied continuously is a little larger than 7, the refeeding operation may not be started immediately after the first pressing operation, and a timer may be provided as shown in FIG. 7(*d*) so that the sheet refeeding operation can be started a little after the first pressing operation.

When a sheet refeeding operation is started in the middle of a process in which copied sheets are stacked on the intermediate tray 110, the front side copying operation can transfer to the reverse side copying operation at the same interval as that of a usual continuous copying operation. That is, in the case of two-sided recording or multi-recording, a plurality of sheets which have been continuously recorded, are subjected to another continuous recording process. At this time, the sheet feeding operation can be quickly transferred to the aforementioned sheet refeeding operation, so that the operation speed can be increased.

Next, referring to FIG. 7(*f*), the 7th example of the sheet conveyance operation in the two-sided copying mode will be explained as follows. In this example, a period of time required to reverse a document is shorter than the sheet conveyance time interval in the case of continuous copying, and the number of sheets P1, both sides of which are to be copied, is 15. The 7th example 7 and the 5th example have many common operations, so that only different points are briefly explained.

When stacking sensor PS1 detects that the 9th sheet P1, the front side of which was already copied, has been stacked on the intermediate tray 110, the one-revolution-clutch 142 is turned on so that the first to the 9th sheet P1 on the intermediate tray 110 are pressed by sheet pressing member PR. Immediately after the pressing operation has been completed, the sheet refeeding clutch 119 is intermittently turned on, and sheets P1 on the intermediate tray 110, one side of which has already been copied, are successively conveyed out in the order from the bottom to the top.

When stacking sensor PS1 detects that the last 15th sheet has been stacked, the one-revolution-clutch 142 is turned on again so that the 7th to 15th sheet P1 on the intermediate tray 110 can be pressed by sheet pressing member PR, wherein the first to 6th sheet were already sent out.

As described above, in this example, only when sheet pressing member PR is rotated twice, all sheets P1 are conveyed out while they are necessarily pressed.

Both samples shown in FIGS. 7(*a*) and 7(*b*) indicate that the first group has 9 sheets, the second group has 8 sheets and a predetermined number of sheets to start feeding a sheet is 11 sheets; example shown in FIG. 7(*c*) indicates that the first group has 7 sheets, the second group has 7 sheets and a predetermined number of sheets to start feeding a sheet is 15 sheets; example shown in FIG. 7(*d*) indicates that the first group has 3 sheets, the second group has 4 sheets and a predetermined number of sheets to start feeding a sheet is 4 sheets; example shown in FIG. 7(*e*) indicates that the first group has 1 sheet, the second group has 1 sheet and a predetermined number of sheets to start feeding a sheet is 1 sheet; and example shown in FIG. 7(*f*) indicates that the first group has 9 sheets, the second group has 6 sheets and a predetermined number of sheets to start feeding a sheet is 9 sheets.

As explained above, according to the sheet refeeding device of the present invention, when a plurality of sheets which have been continuously recorded once, are subjected to another recording process, the sheet feeding operation can be quickly transferred to a sheet refeeding operation for another recording process. Consequently, the speed of the two-sided recording and the multi-recording operation can be increased.

What is claimed is:

1. A sheet feeding device for an image forming apparatus including processing means for recording images onto recording sheets, comprising:

(a) stacking means for sequentially stacking at least two groups totaling a set number of recording sheets on which a first image has been formed by the processing means;

(b) feeding means for sequentially feeding each of said sheets of said groups stacked on said stacking means to the processing means for a second image to be formed, said feeding means coming into contact with the lowermost sheet of each of said groups of said stacked sheets;

(c) sheet pressing means for respectively pressing said groups of stacked sheets toward said feeding means;

(d) feeding start control means for controlling said feeding means to start feeding the lowermost sheet of a first of said groups when a predetermined number of recording sheets is stacked in said stacking means, said predetermined number being less than said set number; and (e) pressing control means for controlling said sheet pressing means to apply pressure on a first group of said groups of stacked sheets before said feeding start control means controls the feeding means to start feeding, and to apply pressure to a second group of said groups of recording sheets when such second group is stacked in said stacking means.

2. The device of claim 1, further comprising feeding control means for controlling said feeding means so that a feeding timing of a first sheet after pressure has been released and re-applied by the control of said pressing control means, is delayed compared with a feeding timing of other sheets when a pressing operation completion timing of said sheet pressing means with regard to sheets is later than a sheet feeding start timing of said sheet feeding means.

3. The device of claim 1, wherein said pressing control means controls said sheet pressing means to apply pressure on the uppermost sheet of said predetermined number of sheets in the first image forming operation each time said predetermined number of sheets are accommodated on said stacking means.

4. The device of claim 3, wherein said feeding start control means controls said feeding means to start feeding when a sheet spaced by a fixed number of sheets from the last sheet in said set number of sheets in the first image forming operation, the fixed number being not less than one and less than the set number, is accommodated on said stacking means.

5. The device of claim 3, further comprising means for detecting the number of sheets accommodated on said stacking means, said detected number being not less than one, wherein said pressing control means and said feeding start control means respectively control said sheet pressing means and said feeding means, based on a detection result of said detection means.

6. The device of claim 1, wherein said pressing control means controls said pressing means to apply pressure on said stacked sheets when approximately half said set number of sheets in the first image operation have been accommodated on said stacking means.

7. The device of claim 1, wherein said pressing control means controls said pressing means to apply pressure directly on a sheet each time said sheet is accommodated on said stacking means when said set number of sheets in the first image forming operation is less than a fixed number.

8. The device of claim 7, further comprising means for detecting a stacked sheet, wherein said pressing control means controls said sheet pressing means, based on a detection result of said detection means.

9. The device of claim 7, wherein said predetermined number is less than 8.

10. The device of claim 1, wherein said pressing control means controls said pressing means to apply pressure on a first sheet through a sheet preceding by a fixed number from the last sheet in a set number of sheets in a first image forming operation when said sheet preceding by said fixed number of sheets is accommodated on said stacking means.

11. The device of claim 10, further comprising means for detecting the number of sheets accommodated on said stacking means and before a feeding operation of said last sheet is conducted by said feeding means.

* * * * *